US012379196B2

(12) United States Patent
Stjepanovic et al.

(10) Patent No.: US 12,379,196 B2
(45) Date of Patent: Aug. 5, 2025

(54) CONTROL MECHANISM OF A VOLUMETRIC DISPENSER FORMING PART OF A GUNPOWDER DOSING DEVICE

(71) Applicant: ARMANOV D.O.O., Trzin (SI)

(72) Inventors: Savo Stjepanovic, Trzin (SI); Ales Benko, Trzin (SI)

(73) Assignee: ARMANOV D.O.O., Trzin (SI)

( * ) Notice: Subject to any disclaimer, the term of this patent is extended or adjusted under 35 U.S.C. 154(b) by 472 days.

(21) Appl. No.: 17/892,046

(22) Filed: Aug. 19, 2022

(65) Prior Publication Data

US 2023/0324156 A1 Oct. 12, 2023

(30) Foreign Application Priority Data

Apr. 8, 2022 (SI) ..... 202200050

(51) Int. Cl.
*G01F 11/10* (2006.01)
*F42B 33/02* (2006.01)

(52) U.S. Cl.
CPC ..... *F42B 33/0292* (2013.01)

(58) Field of Classification Search
CPC ..... G01F 11/10; G01F 11/18; G01F 11/24; G01F 11/263; G01F 11/268; B65D 83/06; B65D 83/775; F42B 33/0292
USPC ..... 222/308, 359, 438, 440
See application file for complete search history.

(56) References Cited

U.S. PATENT DOCUMENTS 2,550,827 A * 5/1951 Lachmiller ..... G01F 11/24 222/308
2,778,528 A * 1/1957 Corcoran ..... G01F 11/24 222/363
3,013,698 A * 12/1961 Gordon ..... G01F 11/46 222/158
3,386,329 A * 6/1968 Rohrbacher ..... F42B 33/0292 86/31
4,006,842 A * 2/1977 Bassignani ..... G01F 11/40 222/43
4,151,933 A * 5/1979 Myers ..... G01F 11/024 222/548
4,174,058 A * 11/1979 Bassignani ..... G01F 11/24 222/452
4,579,256 A * 4/1986 Heimlich ..... G01F 11/268 222/162

(Continued)

*Primary Examiner* — Charles P. Cheyney
(74) *Attorney, Agent, or Firm* — The Watson IP Group, PLC; Jovan N. Jovanovic

(57) ABSTRACT

A control mechanism of a volumetric dispenser forming part of a gunpowder dosing device, enabling adequate volume control of the gunpowder compartment for easy and accurate dosing of gunpowder. The control mechanism includes a holder with a fastening element attached to the gunpowder compartment and a recess for receiving limiting means, an outer and an inner member, each with a gear section and a synchronising pinion connecting the gear sections. The outer member is coaxially fixed to the head of an adjusting screw. The slide is connected to the adjusting screw. The outer member has a scale and a window for displaying units on a measuring scale. The surface of the outer circumference has shallow grooves which the limiting element engages when the outer member is displaced a fraction of a turn. The inner member has the measuring scale displaying the displacement of the outer member by one complete turn.

13 Claims, 6 Drawing Sheets

(56) References Cited

U.S. PATENT DOCUMENTS

| | | | | | |
|---|---|---|---|---|---|
| 4,708,265 | A * | 11/1987 | Bopst, III | G01F 11/10 | 222/362 |
| 4,830,225 | A * | 5/1989 | Heimlich | G01F 11/268 | 222/440 |
| 4,971,229 | A * | 11/1990 | Heimlich | G01F 11/268 | 222/440 |
| 6,929,158 | B2 * | 8/2005 | Smiley | G01F 11/18 | 222/440 |
| 7,624,665 | B1 * | 12/2009 | Lee | F42B 33/0292 | 86/29 |
| 8,684,237 | B2 * | 4/2014 | Robbins | G01F 11/18 | 222/359 |
| 9,726,467 | B1 * | 8/2017 | Scott | F42B 33/0292 | |

* cited by examiner

CONTROL MECHANISM OF A VOLUMETRIC DISPENSER FORMING PART OF A GUNPOWDER DOSING DEVICE

BACKGROUND OF THE DISCLOSURE

The subject of the invention is a control mechanism of a volumetric dispenser forming part of a gunpowder dosing device. The control mechanism is fixed to the volumetric dispenser by a screw connection, thereby enabling the volume of the gunpowder compartment of the volumetric dispenser to be controlled accordingly and thus enabling the quantity of gunpowder to be dosed easily and accurately based on the type of gunpowder and the case to be filled.

Many professional and amateur shooting sports competitors fill cartridges at home, mainly for more accurate and consistent filling and for lower cost. Used cartridge cases are picked up and reloaded. Reloading of used cartridge cases is applicable to many types of cartridges, in particular to cartridges consisting of case, primer, gunpowder and bullet. Since for training a lot of cartridges are used, it is advantageous to reload used cartridge cases at home. In addition, home-loaded cartridges are of higher quality than factory-loaded cartridges, resulting in better results in training and competitions. Making cartridges at home requires a reloading press, which includes a gunpowder dosing device.

Modern gunpowder is a mixture of charcoal, sulphur and potassium nitrate. This is also called smokeless powder. There are more than 100 types of smokeless powder. Gunpowders also differ in granulation and shape, and can be in the form of spheres, flakes or sticks. Each type of ammunition requires accurate gunpowder dosing and this is enabled for by a volumetric dispenser. Volumetric powder dispensers operate volumetrically, i.e. a set volume of powder is measured. Due to the differences between the gunpowders, this volume has to be adjusted. Each calibre of ammunition requires its own volume of powder, which depends on the type of powder, the weight of the projectile, the type of primer, the total length of the cartridge. Thus, the volume of powder must be adapted to the shooter's preference, even within a given calibre.

Powder dosing devices with a volumetric dispenser and a control knob fixed to the head of a control screw are known from prior art. An example of such a device is shown in FIG. 1. Rotation of the control knob rotates the adjusting screw, which is connected to a slide by a screw connection, thereby moving the slide along a gunpowder compartment and thereby varying the volume of the gunpowder compartment. The control knob indicates how many partial turns of the knob have been made, but does not provide an indication of how many full turns the knob has been turned.

Micrometer control knobs which also allow the indication of whole knob turns are also known from prior art, but their construction is usually more complex and therefore more expensive. In addition, control knobs have a greater depth and thus take up more space, which is not desirable for users. On progressive reloading presses intended for home use, the dies and the dosing device are usually very close together.

SUMMARY OF THE DISCLOSURE

The above drawbacks are solved by a control mechanism according to the invention, where the control mechanism, i.e. the control knob, comprises at least three gears, all of which are located inside the outer member, thereby reducing the depth of the control mechanism itself. The construction of the mechanism is simple and inexpensive. In addition, the construction of the control mechanism, by means of shallow grooves formed along the outer circumference of the outer member and limiting means, makes it possible to carry out reproducible adjustments of the volumetric dispenser in a simple manner and thus to dose the quantity of gunpowder easily and accurately depending on the type of gunpowder and the case to be filled.

BRIEF DESCRIPTION OF THE DRAWINGS

The invention will be described in the following and presented in the drawings, in which.

DETAILED DESCRIPTION OF THE DISCLOSURE

Figure 1:
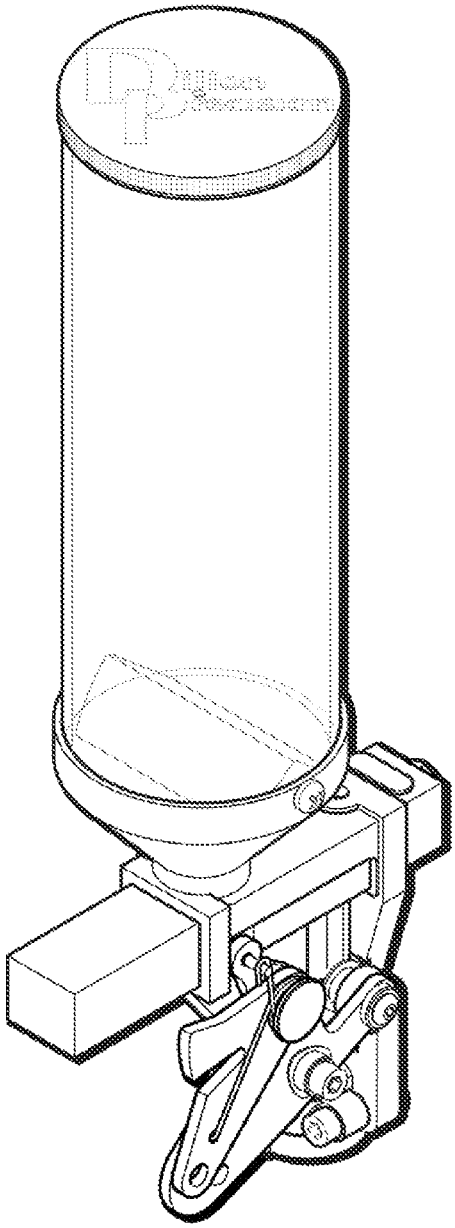
FIG. 1 shows a prior art example of a gunpowder dosing device with a volumetric dispenser
Figure 2:
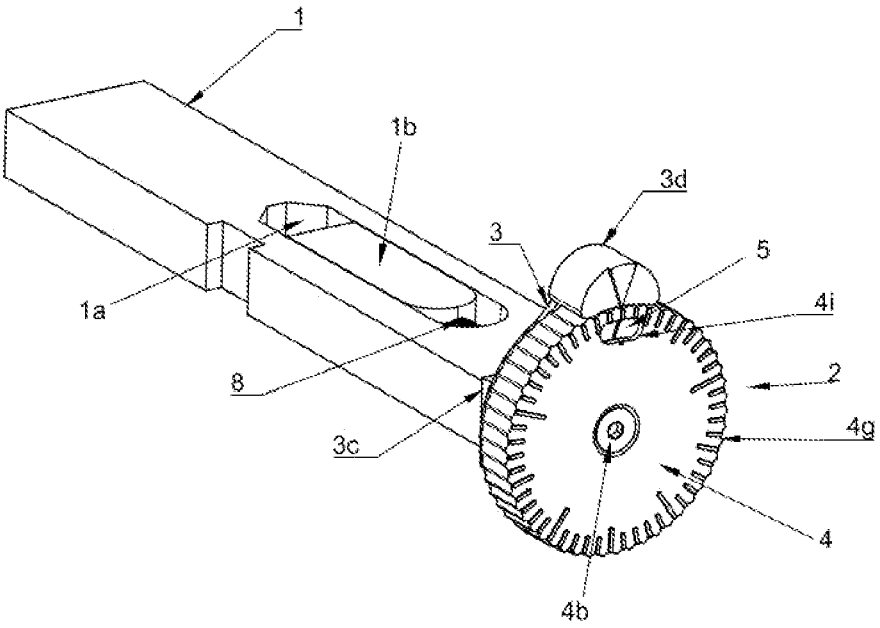
FIG. 2 shows a volumetric gunpowder dispenser with a control mechanism according to the invention in a position where the gunpowder compartment is half open
Figure 3:
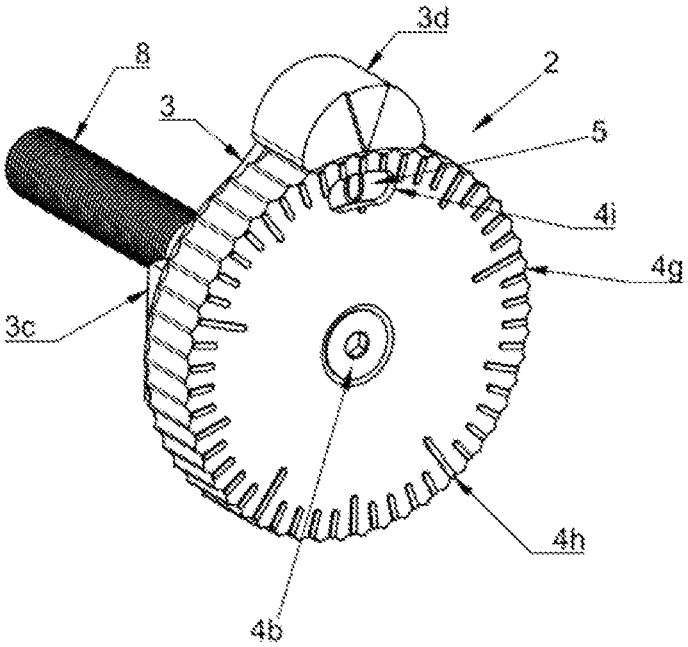
FIG. 3 shows the control mechanism in axonometric projection
Figure 4:
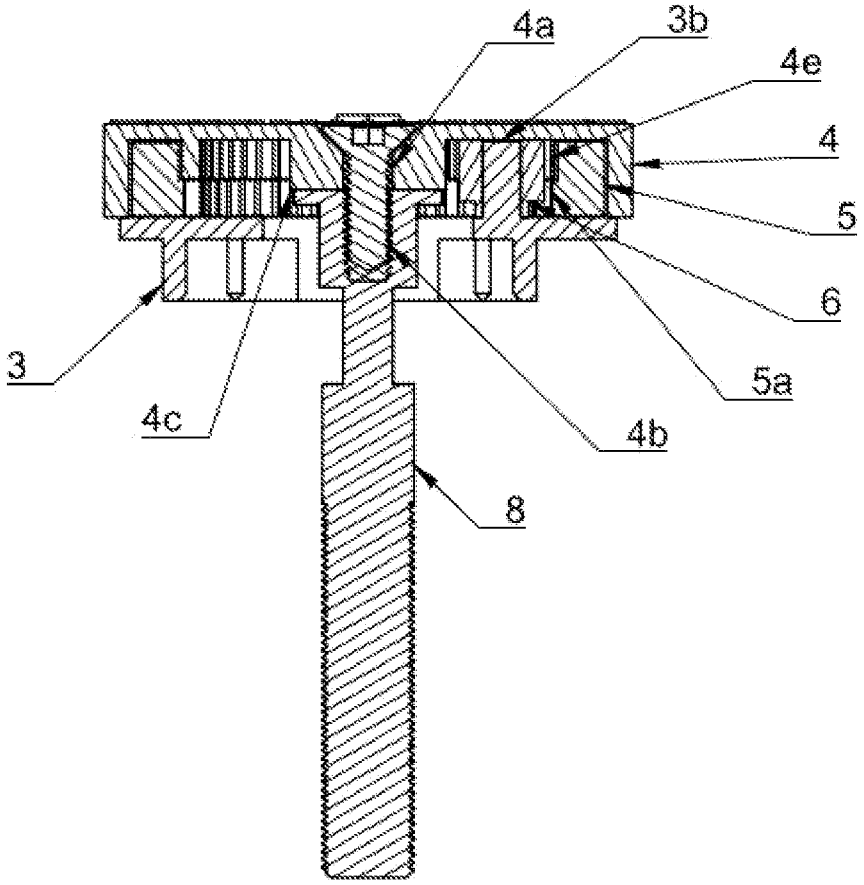
FIG. 4 shows the control mechanism in a longitudinal cross-section

A control mechanism 2 of a volumetric dispenser 1 forming part of a gunpowder dosing device, wherein the volumetric dispenser 1 includes a gunpowder compartment 1*a* and a slide 1*b*, the slide 1*b* being connected to an adjusting screw 8, such that the slide 1*b* and the adjusting screw 8 form a screw connection, whereby rotation of the control screw 8 moves the slide 1*b* along the gunpowder compartment 1*a* and thereby varies the volume of the gunpowder compartment 1*a*, includes

- a holder 3, an outer member 4 with a first gear section 4*e*, an inner member 5 with a second gear section 5*a* and at least one synchronising pinion 6 for connecting the first gear section 4*e* and the second gear section 5*a;*
- wherein the holder 3 is adapted for fixed attachment to the gunpowder compartment 1*a*, and wherein the holder 3 determines the position of the outer member 4 and the position of the at least one synchronising pinion 6, and as a result the position of the inner member 5;
- wherein the outer member 4 is adapted to be coaxially fixed to the head of the adjusting screw 8 and the slide 1*b* is connected to the shank of the adjusting screw 8 by a screw connection;
- wherein the inner member 5 is inserted into the outer member 4 in such a way that the connection between the first gear section 4*e* and the second gear section 5*a* is made by means of at least one of the synchronising pinion 6, whereby the first gear section 4*e*, the second gear section 5*a* and the at least one synchronising pinion 6 form a gear set, thereby enabling the rotation of the outer member 4, which entails the rotation of the synchronising pinion 6 and, through it, the inner member 5 about the same axis as the outer member 4;
- wherein the outer member 4 is adapted to display a displacement of the outer member 4 for a fraction of a turn, and the outer member 4 is provided with a window 4*i* for displaying units on a measuring scale 5*b*, and wherein the inner member 5 is provided with a measuring scale 5*b*, wherein each unit on the measuring scale 5*b* indicates a displacement of the outer member 4 by one complete turn.

The above construction of the control mechanism 2 thus makes it possible to precisely determine the position of the slide 1*b* and thus the volume of the gunpowder compartment 1*a* each time depending on the gunpowder used and the case to be filled.

The control mechanism 2 is formed axially symmetrically, namely the outer member 4, the inner member 5 and the adjusting screw 8 are connected to each other in such a way as to allow their rotation about the same axis.

The holder 3 is formed as an annular body, a central opening 3*a* being configured to receive a projection 4*c* provided on the outer member 4 for connecting the outer member 4 to the holder 3, so as to allow free rotation of the outer member 4. The holder 3 is provided on its inner face with at least one axle 3*b* for receiving the synchronising pinion 6. On the outer face, the holder 3 is provided with a fastening element 3*c* for fixed attachment of the holder 3 to the gunpowder compartment 1*a*. In one embodiment, the holder 3 is provided in a portion of the outer circumference with a recess 3*d* for receiving limiting means 7 comprising a limiting member 7*a* and a spring member 7*b*.

The outer member 4 is formed as an annular body having a hole 4*a* in the centre for receiving a fixing screw 4*b* for fixed attachment of the outer member 4 to the head of the adjusting screw 8. On the inner side, i.e. the side facing the holder 3, the outer member 4 is provided around the opening 4*a* with an axially symmetrically arranged projection 4*c* for abutment of the outer member 4 into the central opening 3*a* of the holder 3. On the inner side, the outer member 4 has a first gear section 4*e* at a certain distance from an outer circumference 4*d*, so that a circumferential groove 4*f* is formed between the outer circumference 4*d* and the first gear section 4*e* to receive the inner member 5. The height of the first gear section 4*e* is approximately half the height of the outer member 4.

To show the displacement of the outer member 4 for a fraction of a turn, the surface of the outer circumference 4*d* is formed with shallow grooves 4*g* which the limiting element 7*a* engages when the outer member 4 is displaced for a fraction of a turn. The shallow grooves 4*g*, together with the limiting means 7, essentially allow the individual partial turns of the outer member 4 to be discretised (no intermediate positions are possible), only a limited number of partial turns per complete turn of the outer member 4 is possible, which is determined by the number of shallow grooves 4*g*. Each shallow groove 4*g* thus represents a fraction of a turn of the outer member 4 within a single complete turn, i.e. one station. One complete turn of the outer member 4 consists of all stations, and each partial turn of the outer member 4 between two consecutive complete turns is represented by a single station.

In order to facilitate the reading of the number of partial displacements of the outer member 4 within each complete turn, i.e. by how many partial turns the outer member 4 has moved, the outer member 4 is provided at its outer surface with a scale 4*h* with markings, the number of markings on the scale 4*h* being equal to the number of shallow grooves 4*g*. The markings on the scale 4*h* are preferably bars.

The limiting means 7 also provide audible information of any displacement of the outer member 4 for a fraction of a turn. Namely, each time the outer member 4 is moved a fraction of a turn, a "click" is heard when the limiting element 7*a* fits into the shallow groove 4*g*, this is an acoustic signal that a partial turn of the outer member 4 has been completed. The limiting element 7*a* is preferably a ball, the spring element 7*b* is a spring.

A window 4*i* is provided on the outer member 4 for displaying units on the scale 5*b* which is formed on the inner member 5, each unit on the scale 5*b* representing a displacement of the outer element 4 by one complete turn.

The inner member 5 is formed as an annular body having the second gear section 5*a* on the inner side, i.e. the side facing away from the outer member 4 when the inner member 5 is inserted into the circumferential groove 4*f*, along the inner circumference. The height of the second gear section 5*a* is approximately half the height of the inner member 5. When the inner member 5 is inserted into the circumferential groove 4*f*, i.e. the outer member 4, the gear sections 4*e*, 5*a* are positioned one above the other. On the surface, which faces the outer member 4 when the inner member 5 is inserted into the circumferential groove 4*f*, the inner member 5 is provided with the measuring scale 5*b*, wherein each unit on the measuring scale 5*b* indicates a displacement of the outer member 4 by one complete turn. The measuring scale 5*b* is preferably a dial, each number on the dial indicating a displacement of the outer member 4 by one complete turn.

The outer radius of the inner member 5 is so much smaller than the outer radius of the circumferential groove 4*f* that as the outer member 4 is rotated the inner member 5 can smoothly rotate simultaneously within the circumferential groove 4*f* via the at least one synchronising pinion 6.

The individual synchronising pinion 6 is positioned on the axle 3*b* which is formed on the inner face of the holder 3, the axle 3*b* and hence the synchronising pinion 6 being positioned such that the teeth $Z_S$ of the synchronising pinion 6 engage the teeth $Z_1$ of the first gear section 4*e* and the teeth $Z_2$ of the second gear section 5*a*. By rotating the outer member 4, the synchronising pinion 6 enables the rotation to be transferred between the gear sections 4*e*, 5*a* and thus the rotation of the inner member 5.

The length of the synchronising pinion 6 along the axis of rotation of the synchronising pinion 6 is long enough so that the teeth $Z_S$ of the synchronising pinion 6 engage the teeth $Z_1$ of the first gear section 4*e* in one part of the length and the teeth $Z_2$ of the second gear section 5*a* in the other part of the length.

The number of teeth $Z_1$ of the first gear section 4*e* differs from the number of teeth $Z_2$ of the second gear section 5*a*; the number of teeth $Z_1$ of the first gear section 4*e* may be correspondingly higher or correspondingly lower than the number of teeth $Z_2$ of the second gear section 5*a*. A difference in the number of teeth allows the inner member 5 to be rotated by so much more or so much less in one complete turn of the outer member 4 that the next turn number is displayed in the window 4*i*, thus allowing the number of complete turns of the outer member 4 to be uniquely determined.

In one preferred embodiment, the number of teeth $Z_2$ of the second gear section 5*a* is correspondingly lower than the number of teeth $Z_1$ of the first gear section 4*e*, thereby allowing the inner member 5 to rotate slightly more than the outer member 4 in one complete turn of the outer member 4. In this way, the inner member 5 is rotated by so much more in one complete turn of the outer member 4 that the next turn number is displayed in the window 4*i*, thus allowing the number of complete turns of the outer member 4 to be uniquely determined. Since the outer member 4 normally rotates in a clockwise direction, the numbers on the measuring scale 5*b* follow each other in reverse order viewed in the clockwise direction, i. e. from the highest to the lowest one.

In another embodiment, the number of teeth $Z_2$ of the second gear section 5*a* is correspondingly higher than the number of teeth $Z_1$ of the first gear section 4*e*, thereby allowing the inner member 5 to rotate slightly less than the outer member 4 in one complete turn of the outer member 4. In this way the inner member 5 is rotated by so much less in one complete turn of the outer member 4 that the next turn number is displayed in the window 4*i*, thus allowing the number of complete turns of the outer member 4 to be uniquely determined. In this case, the numbers on the measuring scale 5*b* run from lowest to highest.

Figure 5:
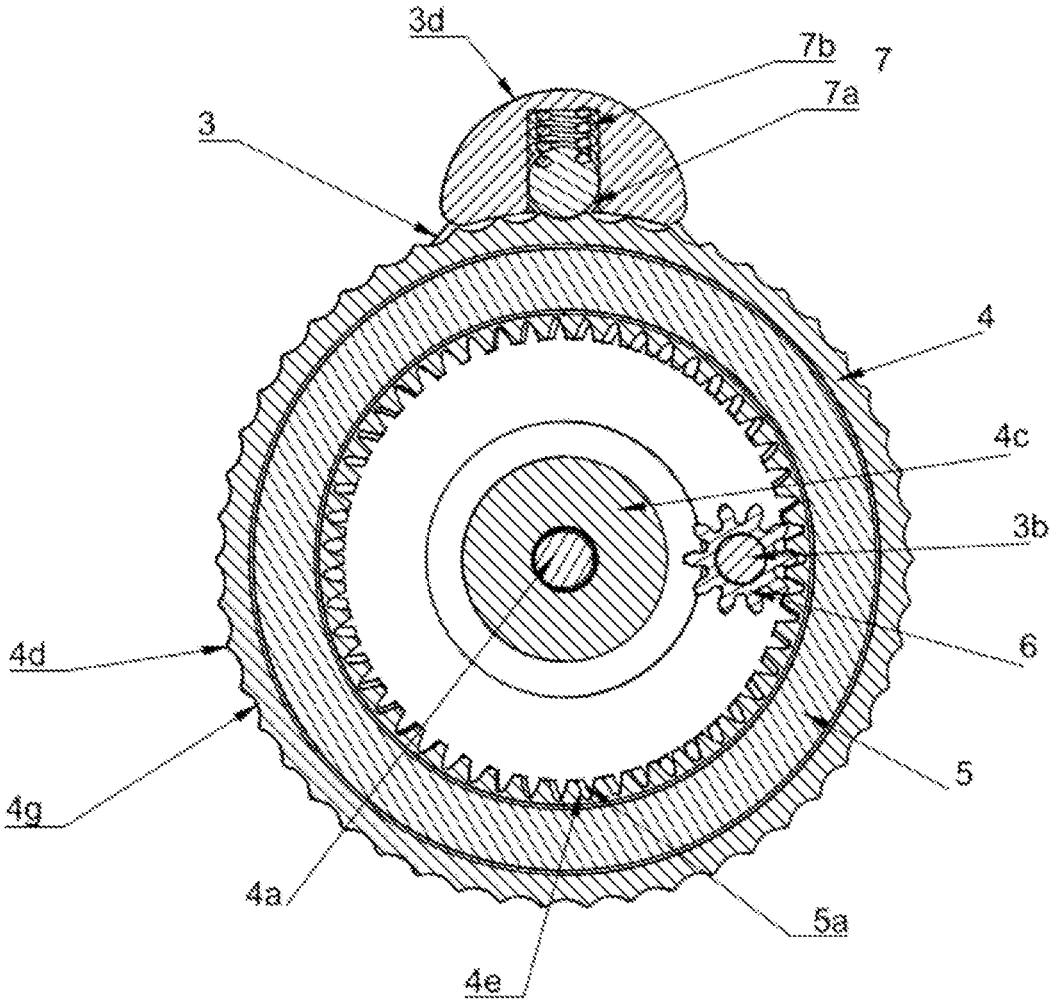
FIG. 5 shows one embodiment of the control mechanism in a transversal cross-section
Figure 6:
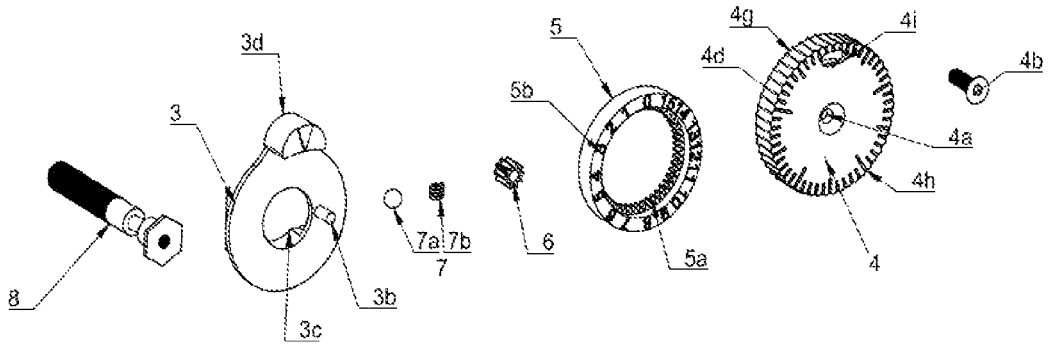
FIG. 6 shows the control mechanism from FIG. 5 in a dismantled connection—front view
Figure 7:
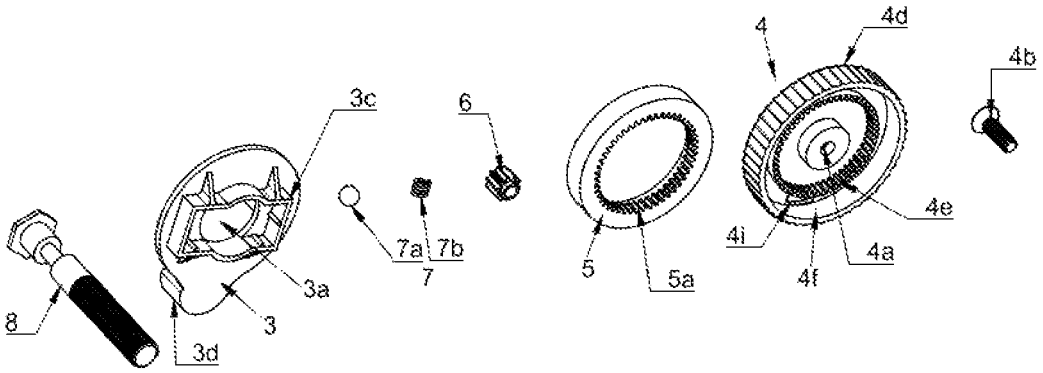
FIG. 7 shows the control mechanism from FIG. 5 in a dismantled connection—rear view

In one embodiment shown in FIGS. 5 to 7, the control mechanism 2 includes one synchronising pinion 6.

Figure 8:
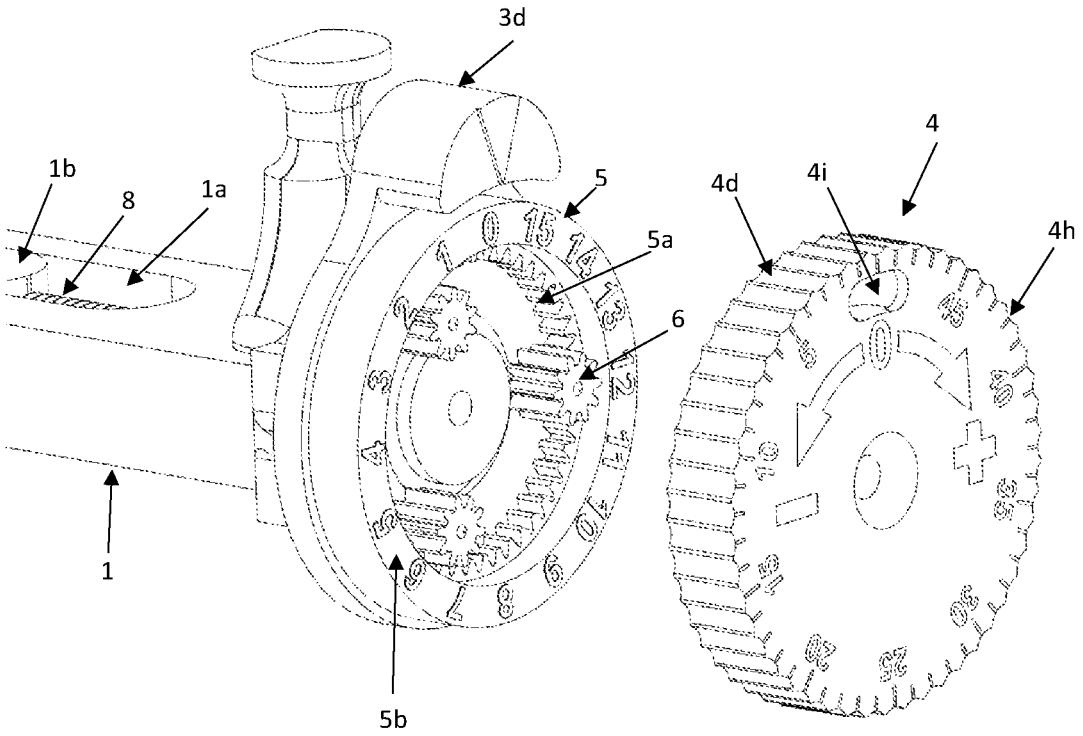
FIG. 8 shows another embodiment of the control mechanism in a transversal cross-section.

In the second, preferred embodiment, shown in FIG. 8, the control mechanism 2 includes three synchronising pinions 6, the synchronising pinions 6 being arranged so that the cooperation areas between the teeth $Z_S$ of each synchronising pinion 6 and the teeth $Z_1$ of the first gear section 4*e* and the teeth $Z_2$ of the second gear section 5*a* evenly distributed around the circumference of the first gear section 4*e* and the second gear section 5*a*. In this case, the holder 3 has three axles 3*b* on its inner face for receiving the synchronising pinions 6. In this case, the number of teeth $Z_1$ of the first gear section 4*e* is for three larger or three smaller than the number of teeth $Z_2$ of the second gear section 5*a*. The use of three synchronising pinions 6 allows the adjusting screw 8 to be more axially stable, which means that when making the gunpowder dosing device, greater tolerances are allowed that do not affect the final accuracy of the gunpowder dosing device, or within the same tolerances, the accuracy of the gunpowder dosing device is improved.

With the control mechanism of the invention, for each type of gunpowder and for each type of case or cartridge, the position of the control mechanism 2, i.e. the position of the adjusting screw 8, and hence the position of the slide 1*b* and hence the volume of the powder compartment 1*a*, can be uniquely determined in advance.

Embodiments

Control Mechanism with One Synchronising Pinion

In the embodiment, it is foreseen for the adjusting screw 8 to turn by 16 complete turns. To this end, the outer member 4 has a first gear section 4*f* with the tooth number $Z_1$=51, the inner member 5 has a second gear section 5*a* with the tooth number $Z_2$=48 and the synchronising pinion 6 has the tooth number $Z_S$=10. When the adjusting screw 8 is turned by a complete turn, i.e. when the outer member 4 is turned a complete turn, the inner member 5 is turned by a complete turn and three teeth more, thus displaying in the window 4*i* the next consecutive number of a complete turn, which is located on the measuring scale 5*b*. The number of shallow grooves 4*g* formed on the surface of the outer circumference 4*d* of the outer member 4 is fifty, which means that the complete turn of the outer member 4 is further divided into fifty partial turns. The ball 7*a*, with the help of the spring 7*b*, jumps into the next shallow groove 4*g* at each partial turn, which sounds like a click. To make it easier to read by how many partial turns the outer member 4 has moved, the outer member 4 is provided at its outer surface with a scale 4*h* with markings. The scale 4*h* has a bar at each shallow groove 4*g*, which is longer at 5 clicks and even longer at 10 clicks.

Control Mechanism with Three Synchronising Pinions

The difference with the first embodiment is that the control mechanism 2 includes three synchronising pinions 6, which are arranged at equal intervals so that the areas of cooperation between the teeth $Z_S$ of each synchronising pinion 6 and the teeth $Z_1$ of the first gear section 4*e* and the teeth $Z_2$ of the second gear section 5*a* evenly distributed around the circumference of one and the other gear section 4*e*, 5*a*. The number of teeth $Z_1$ of the first gear section 4*e* is 51, the number of teeth $Z_2$ of the second gear section 5*a* is 48, the number of teeth $Z_S$ of each synchronising pinion is 10.

LIST OF REFERENCE SIGNS

1—volumetric dispenser; 1*a*—gunpowder compartment; 1*b*—slide
2—control mechanism
3—holder; 3*a*—central opening; 3*b*—axle; 3*c*—fastening element; 3*d*—recess
4—outer member; 4*a*—opening; 4*b*—fastening screw; 4*c*—projection; 4*d*—outer circumference; 4*f*—first gear section; 4*f*—circumferential groove; 4*g*—shallow groove; 4*h*—scale; 4*i*—window
5—inner member; 5*a*—second gear section; 5*b*—measuring scale
6—sinchronising pinion
7—limiting means; 7*a*—limiting element; 7*b*—spring element
8—adjusting screw

The invention claimed is:

1. A control mechanism (2) of a volumetric dispenser (1) forming part of a gunpowder dosing device, wherein the volumetric dispenser (1) includes a gunpowder compartment (1*a*) and a slide (1*b*), wherein the slide (1*b*) is connected to an adjusting screw (8), whereby rotation of the adjusting screw (8) moves the slide (1*b*) along the gunpowder compartment (1*a*), thereby varying the volume of the gunpowder compartment (1*a*);

characterized in that the control mechanism (2) includes a holder (3), an outer member (4) with a first gear section (4*e*), an inner member (5) with a second gear section (5*a*) and at least one synchronizing pinion (6) for connecting the first gear section (4*e*) and the second gear section (5*a*);

wherein the holder (3) is adapted for fixed attachment to the gunpowder compartment (1*a*), and wherein the holder (3) determines the position of the outer member (4) and the position of said at least one synchronizing pinion (6), and as a result, the position of the inner member (5);

wherein the adjusting screw includes a head on the outer end of the adjusting screw and a stem on an inner end of the adjusting screw, and wherein the outer member (4) is adapted to be coaxially fixed to the head of the adjusting screw (8) and the slide (1*b*) is connected to the stem of the adjusting screw (8) by a screw connection;

wherein the inner member (5) is inserted into the outer member (4) in such a way that the connection between the first gear section (4*e*) and the second gear section (5*a*) is made by means of said at least one synchronizing pinion (6), whereby the first gear section (4*e*), the second gear section (5*a*) and said at least one synchronizing pinion (6) form a gear set, thereby enabling the rotation of the outer member (4), which entails the rotation the synchronizing pinion (6) and, in turn, the inner member (5) about the same axis as the outer member (4);

wherein the outer member (4) is adapted to display a displacement of the outer member (4) for a fraction of a turn, and the outer member (4) is provided with a window (41) for displaying units on a measuring scale (5*b*); and wherein the inner member (5) is provided with a measuring scale (5*b*), wherein each unit on the measuring scale (5*b*) indicates a displacement of the outer member (4) by one complete turn.

2. The control mechanism (2) according to claim 1, characterized in that the holder (3) is formed as an annular body, a central opening (3*a*) being configured to receive a projection (4*c*) provided on the outer member (4) for connecting the outer member (4) to the holder (3) to allow free rotation of the outer member (4), the holder (3) being provided on its outer face with at least one axle (3*b*) for receiving the synchronising pinion (6), and the holder (3) being provided on the inner face with a fastening element (3*c*) for fixed attachment of the holder (3) to the gunpowder compartment (la), and the holder (3) is provided in a portion of the outer circumference with a recess (3*d*) for receiving limiting means (7) comprising a limiting member (7*a*) and a spring member (7*b*).

3. The control mechanism (2) according to claim 1, characterized in that the outer member (4) is formed as an annular body, wherein an opening (4*a*) is formed in a center of the outer member to receive a fastening screw (4*b*) for fixed attachment of the outer member (4) to the head of the adjusting screw (8), and wherein the outer member (4) is provided on an inner side facing the holder (3), around the opening (4*a*) with an axially symmetrically arranged projection (4*c*) for abutment of the outer member (4) into the central opening (3*a*) of the holder (3).

4. The control mechanism (2) according to claim 1, characterized in that on its inner side the outer member (4) has the first gear section (4*e*) at a distance from an outer circumference (4*d*), so that a circumferential groove (4*f*) is formed between the outer circumference (4*d*) and the first gear section (4*e*) to receive the inner member (5), and the surface of the outer circumference (4*d*) is formed with shallow grooves (4*g*) which the limiting element (7*a*) engages when the outer member (4) is displaced for a fraction of a turn.

5. The control mechanism (2) according to claim 4, characterized in that the inner member (5) is formed as an annular body having the second gear part (5*a*) on an inner side facing away from the outer member (4) when the inner member (5) is inserted into the circumferential groove (4*f*), along the inner circumference, wherein, when the inner member (5) is inserted into the circumferential groove (4*f*), the gear sections (4*e*, 5*a*) are positioned one above the other, and the inner member (5) is provided on the surface, which faces the outer member (4) when the inner member (5) is inserted into the circumferential groove (4*f*), with the measuring scale (5*b*).

6. The control mechanism (2) according to claim 4, characterized in that the outer radius of the inner member (5) is so much smaller than the outer radius of the circumferential groove (4*f*) that as the outer member (4) is rotated the inner member (5) smoothly rotates simultaneously within the circumferential groove (4*f*) via said at least one synchronizing pinion (6).

7. The control mechanism (2) according to claim 1, characterized in that the synchronizing pinion (6) is positioned such that the teeth ($Z_S$) of the synchronizing pinion (6) engage the teeth ($Z_1$) of the first gear section (4*e*) and the teeth ($Z_2$) of the second gear section (5*a*), thereby allowing the rotation to be transferred between the gear sections (4*e*, 5*a*) and thus the rotation of the inner member (5).

8. The control mechanism (2) according to claim 1, characterized in that the length of the synchronizing gear (6) along the axis of rotation of the synchronizing pinion (6) is long enough so that the teeth ($Z_S$) of the synchronizing pinion (6) engage the teeth ($Z_1$) of the first gear section (4*e*) in one part of the length and the teeth ($Z_2$) of the second gear section (5*a*) in the other part of the length.

9. The control mechanism (2) according to claim 1, characterized in that the number of teeth ($Z_1$) of the first gear section (4*e*) is adequately higher or adequately lower than the number of teeth ($Z_2$) of the second gear section (5*a*), thereby allowing the inner member (5) to be rotated by so much more or so much less in one complete turn of the outer member (4) that the next turn number is displayed in the window (4*i*), thus allowing the number of complete turns of the outer member (4) to be uniquely determined.

10. The control mechanism (2) according to claim 1, characterized in that the control mechanism (2) includes three synchronizing pinions (6), which are arranged at equal intervals so that the areas of cooperation between the teeth ($Z_S$) of each synchronizing pinion (6) and the teeth ($Z_1$) of the first gear section (4*e*) and the teeth ($Z_2$) of the second gear section (5*a*) evenly distributed around the circumference of one and the other gear section (4*e*, 5*a*), and the number of teeth ($Z_1$) of the first gear section (4*e*) is for three larger or three smaller than the number of teeth ($Z_2$) of the second gear section (5*a*).

11. The control mechanism (2) according to claim 1, characterized in that the outer member (4) has the first gear section (4*f*) with the number of teeth ($Z_1$) being 51, the inner member (5) has the second gear section (5*a*) with the number of teeth ($Z_2$) being 48, and the synchronizing pinion 6 has the number of teeth ($Z_S$) equal to 10, and the number of shallow grooves (4*g*) formed on the surface of the outer circumference (4*d*) of the outer member (4) is fifty.

12. A volumetric dispenser (1) characterized by including the control mechanism (2) according to claim 1.

13. A gunpowder dosing device characterized by including the control mechanism (2) according to claim 1.

* * * * *